United States Patent [19]

Ray

[11] 4,095,793

[45] Jun. 20, 1978

[54] MARBLE GAME RESEMBLING GOLF

[76] Inventor: Otis Eugene Ray, P.O. Box 40302, St. Petersburg, Fla. 33743

[21] Appl. No.: 784,338

[22] Filed: Apr. 4, 1977

[51] Int. Cl.[2] ..... A63F 7/06
[52] U.S. Cl. ..... 273/87 R
[58] Field of Search ..... 273/87, 87.2, 87.4, 273/123 R

[56] References Cited

U.S. PATENT DOCUMENTS

| | | | |
|---|---|---|---|
| 1,548,291 | 8/1925 | Van Arsdale, Jr. | 273/87.2 |
| 1,627,517 | 5/1927 | Littleford, Jr. | 273/87.2 |
| 2,014,993 | 9/1935 | Stayton | 273/87.4 |
| 2,750,192 | 6/1956 | Haslett | 273/87.2 |
| 3,186,127 | 6/1965 | Berendt et al. | 46/156 X |

FOREIGN PATENT DOCUMENTS

| | | | |
|---|---|---|---|
| 725,616 | 2/1932 | France | 273/87.2 |

OTHER PUBLICATIONS

The Science Teacher, Feb. 1974, p. 48.

*Primary Examiner*—Anton O. Oechsle
*Attorney, Agent, or Firm*—B. P. Fishburne, Jr.

[57] ABSTRACT

A simplified and inexpensive table game resembling golf is played with marbles propelled by the fingers of players on an imitation grass playing surface. The playing surface has cut-outs to resemble sand and water hazards as well as the holes of a golf course. A plastic or oil cloth underlay is colored to be visible through the cut-outs so that the sand and water hazards will appear realistically to the players of the game. Simplified hole marker flags are constructed from bent pipe cleaners.

2 Claims, 5 Drawing Figures

FIG.1
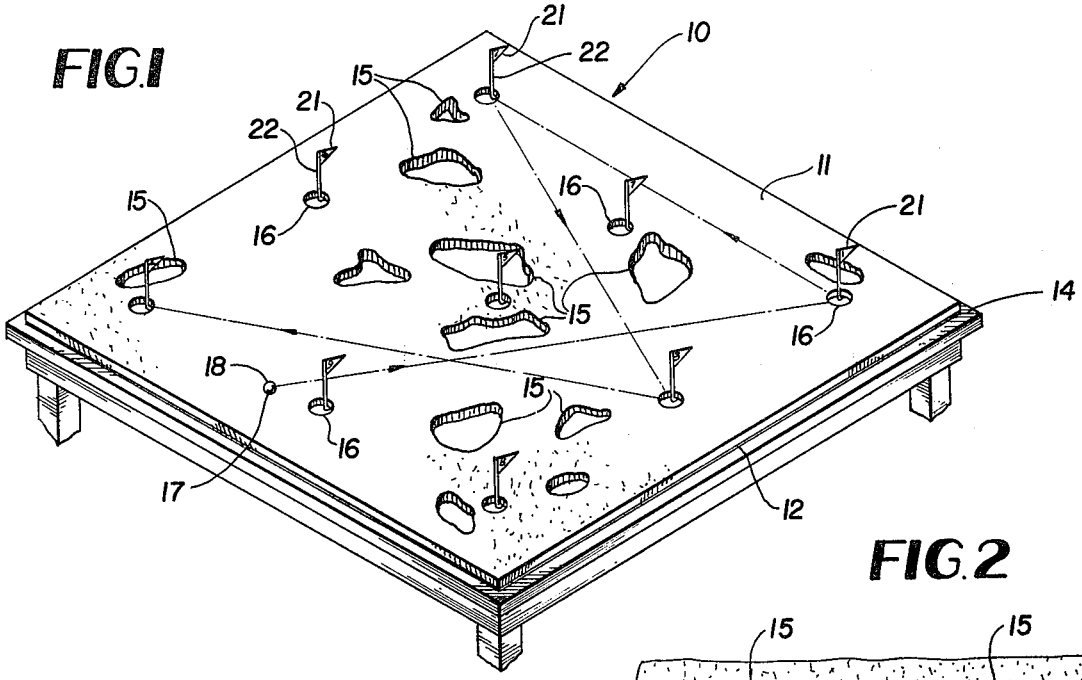
FIG.2
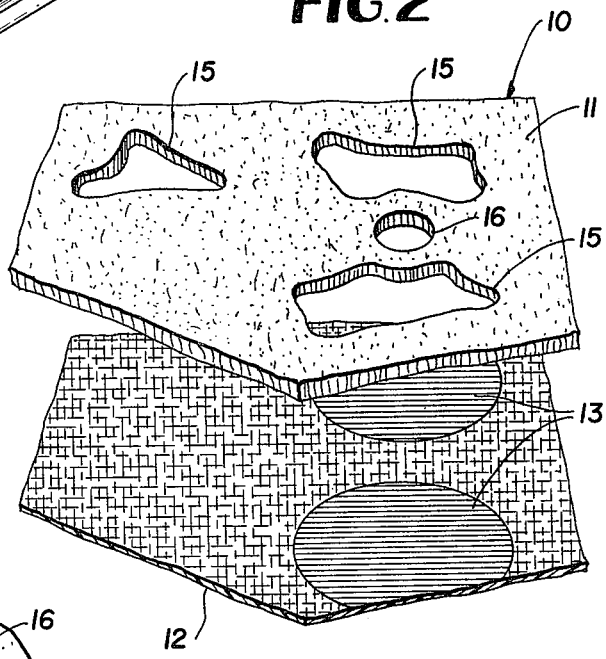
FIG.3
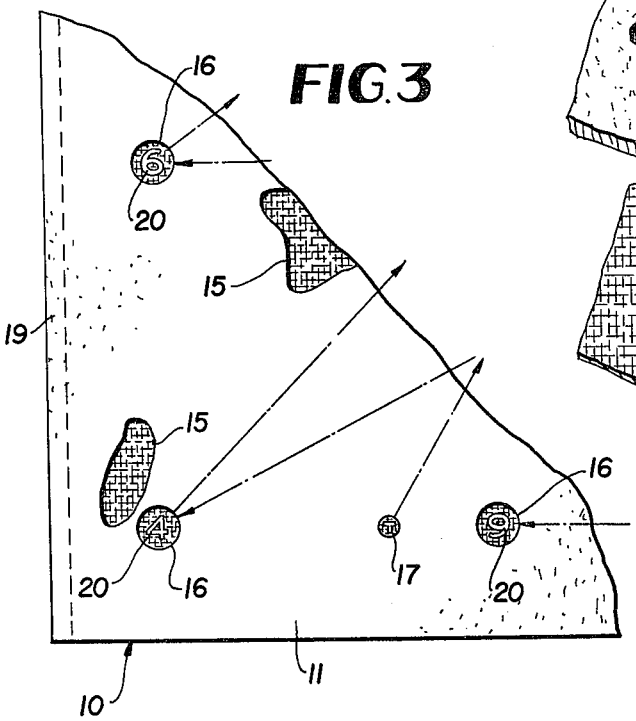
FIG.4
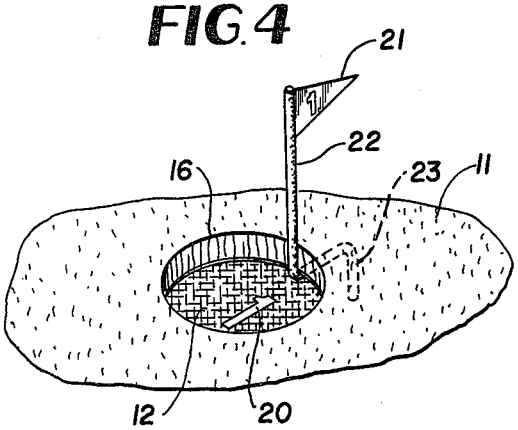
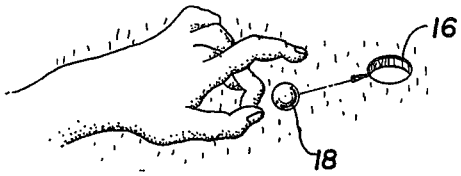
FIG.5

MARBLE GAME RESEMBLING GOLF

BACKGROUND OF THE INVENTION

Various indoor golf games are known in the prior art and these games vary in size and construction, some being quite sophisticated and comparatively costly to manufacture. Examples of the patented prior art are contained in U.S. Pat. Nos. 663,522; 720,191; 1,548,291; 1,864,500; and 3,534,961. Some of the prior art apparatuses involve rather costly contoured playing surfaces and some of the games require playing clubs. Others are played with discs resembling the game of "Tiddleywinks".

The object of the present invention is to improve on the known prior art by providing a more simplified and less costly table game which is played with marbles on a card table or the like and requires no miniature clubs or other expensive accessories.

The game apparatus consists essentially of an imitation grass playing surface or sheet beneath which a plastic or oil cloth underlay sheet is positioned and has colored areas adapted to register with variously spaced cut-outs in the imitation grass playing surface so that some of the cut-outs will appear to the players of the game as water hazards while other cut-outs will appear as sand traps. The two superposed sheets can be joined in proper registration along one end only of the rectangular mat structure. The structure is flexible, lightweight and attractive in appearance and preferably is sized to fit on a standard card table without the need for a marginal frame or other support. Other small circular cut-outs in the imitation grass mat resemble golf course holes and the numbers of the holes may be imprinted on the underlay sheet for registry with the hole cut-outs. Paper marker flags are conveniently attached to bent pipe cleaners whose base ends are slid under the imitation grass mat at each hole of the course. Preferably four white marbles are utilized as golf balls, each marble having a different colored dot to identify it. The marbles are propelled from hole-to-hole by the fingers of players. Simplicity and economy are prime considerations in the invention and the game is realistic and entertaining to the young and old.

BRIEF DESCRIPTION OF THE DRAWINGS

FIG. 1 is a perspective view of a table marble game resembling golf according to the invention.

FIG. 2 is an enlarged fragmentary perspective view showing the superposed components of the mat body of the game.

FIG. 3 is a fragmentary corner plan view of the invention.

FIG. 4 is a fragmentary perspective view showing one hole of the golf course.

FIG. 5 is a perspective view illustrating how the game is played with marbles by utilizing the fingers.

DETAILED DESCRIPTION

Referring to the drawings in detail wherein like numerals designate like parts, a rectangular body portion or mat 10 is formed from a top layer or section 11 of imitation grass and is green in color for realism. Any conventional commercial carpet grass can be utilized for the top layer 11. Beneath the layer 11 is an underlay sheet 12 of plastic or oil cloth which is preferably colored yellow over its entire upper surface except for several spaced comparatively small areas 13 which are colored blue to resemble water. The sheet 12 is of the same shape and size as the top layer 11, and both are sized to fit on a standard card table 14 or the like.

The imitation grass layer 11 has plural randomly spaced and randomly shaped and sized cut-outs 15 formed therethrough resembling sand and water hazards on a golf course. The top layer 11 has additional small circular cut-outs 16 resembling the holes or cups of a preferably nine hole golf course. The cut-outs 16 are arranged in predetermined spaced relationship to provide a practical and challenging play path between the various holes of the course without having the paths intersect the cut-outs 15 but in most cases coming close to the cut-outs 15 or "hazards" to render the game challenging. The play path on the golf course is partially illustrated in FIG. 1 by the broken line and is also shown in FIG. 3. An initial tee 17, FIG. 3, is provided in the illustrated example between holes (4) and (9) and a "ball" 18, FIG. 1, in the form of a white preferably 9/16th inch diameter marble, is placed on the tee 17 and propelled initially toward hole (1) at the far corner of the game mat by the use of the finger as illustrated in FIG. 5. From hole (1), the marble is propelled by a player successively around the simulated course as indicated by the arrows in FIG. 1 to holes (2), (3) and (4), and so on throughout the nine holes of the golf course. The layout of holes and hazards can be varied as desired in the formation of the imitation grass mat 11 so that various golf course configurations can be simulated in the invention. As shown in FIG. 1, the various hazards 15 are arranged to lie close to the play path in many instances to make the game more challenging.

Preferably four of the white marbles 18 are utilized, one for each of four players, and each marble having a distinctly colored dot for identification. The playing mat is flexible and requires no frame or rigid base or other support. It can be placed on any table or on the floor, if preferred. It is designed for economy of manufacture and low cost to retail customers.

The colored underlay sheet 12, after being placed in accurate registration with the upper mat 11, is joined to the upper mat adhesively or otherwise along one narrow straight edge area 19, as shown in FIG. 3. The spaced blue colored areas 13 will now register with a corresponding number of the cut-outs 15 in the mat 11, FIG. 2, so that these particular cut-outs will realistically appear as water hazards. All of the other cut-outs will appear as sand traps or hazards due to the yellow coloring of the underlay sheet 12 which will be visible therethrough.

The underlay sheet 12 preferably has hole or cup indicator numbers 20 imprinted thereon so as to be visible to the players through the circular cut-outs 16 of the mat 11. The composite marble game mat thus formed is essentially flat and comparatively thin and does not include any contoured areas to resemble hills or depressions. This is a further economy feature of the invention.

As shown in the drawings, each hole 16 has a preferably paper marker flag 21 attached to a pipe cleaner 22 whose lower end portion has a double bend 23 therein forming a base for the flag which is simply slid under the top mat 11 at the edge of one hole 16. The flag base 23 will be held down and the flag will be held up by the weight of the mat 11 and thus the flags are readily removable from the mat for storage or shipment.

It is thought that in view of the drawings and the foregoing description that the construction and use of the simplified marble game resembling golf and its advantages over the more complex and costly prior art will be readily understood. Essentially, the game apparatus involves two superposed mat layers which are joined in proper registration along at least one edge, the top mat layer being formed of imitation grass and the lower layer being colored to produce the appearance of water and sand hazards when viewed through the cut-outs of the top layer, together with the simplified hole marker flags and individualized marbles resembling golf balls.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A marble game simulating golf comprising a flexible mat constructed and arranged to resemble a golf course and at least one marble to be propelled by a finger of a player of the game on the top surface of the mat, said mat comprising a top comparatively thick carpet grass layer and a comparatively thin bottom layer immediately underlying said top layer, the top carpet grass layer having a plurality of spaced randomly shaped and differently sized cut-outs formed therethrough resembling sand and water hazards on a golf course and having a plurality of comparatively small regularly sized circular cut-outs in spaced relation to the first-named cut-outs and resembling the holes of a golf course, the top surface of said bottom layer being colored and such coloring being visible to a player through the first-named cut-outs to resemble the color of sand and water hazards on a golf course, said top and bottom layers being joined along a marginal edge only to maintain said top and bottom layers in registration, and hole marker flags having standards formed from bendable pipe cleaners and including horizontal bases which are removably insertable between said top and bottom layers at the marginal edge of said circular cut-outs resembling holes of a golf course.

2. A marble game simulating golf as defined in claim 1, and corresponding numeric indicia on said hole marker flags and on the top surface of said bottom layer at locations on the bottom layer which register with said circular cut-outs, said flexible mat being rectangular for convenience of placement on a rectangular table during the use of the marble game.

* * * * *